United States Patent [19]

Saruwatari

[11] Patent Number: 4,773,834

[45] Date of Patent: Sep. 27, 1988

[54] PROGRESSIVE CAVITY PUMP

[75] Inventor: Minoru Saruwatari, Calgary, Canada

[73] Assignee: Patrick J. Quinn, Calgary, Canada

[21] Appl. No.: 24,423

[22] Filed: Mar. 10, 1987

Related U.S. Application Data

[63] Continuation of Ser. No. 638,828, Aug. 8, 1984, abandoned.

[30] Foreign Application Priority Data

Aug. 16, 1983 [CA] Canada ..... 434694

[51] Int. Cl.[4] ..... F04C 2/107; F04C 5/00

[52] U.S. Cl. ..... 418/48; 418/153

[58] Field of Search ..... 418/48, 153, 178

[56] References Cited

U.S. PATENT DOCUMENTS

| | | | |
|---|---|---|---|
| 2,527,673 | 10/1950 | Byram | 418/48 |
| 3,380,391 | 4/1968 | John | 418/48 |
| 4,104,009 | 8/1978 | Chanton | 418/48 |

FOREIGN PATENT DOCUMENTS

| | | | |
|---|---|---|---|
| 352574 | 8/1935 | Canada . | |
| 471680 | 2/1951 | Canada . | |
| 506503 | 10/1954 | Canada . | |
| 840736 | 5/1970 | Canada . | |
| 883561 | 10/1971 | Canada . | |
| 924181 | 4/1973 | Canada . | |
| 2017620 | 11/1971 | Fed. Rep. of Germany | 418/48 |
| 2722623 | 12/1977 | Fed. Rep. of Germany | 418/178 |

OTHER PUBLICATIONS

The Mono Pump, The Modern Pumping Principle-Mono Pumps (Australia) Pty. Ltd.

The Progressing Cavity Down Hole Pump-Tarby Engineering Company.

Becker Pumps, Eliminate Rod Fall Problems and Pump Up To 40% Sand-Conrod Manufacturing Ltd.

Moyno Progressing Cavity Pumps, Bulletin 110A-Robbins Myers, c. 1979.

Operation-Assembly Instructions and Parts List for "L4" Drive End-Robbins Myers.

Ramoy Pumps-Robbins Myers, Apr. 1980.

Continental Progressing Cavity Pumps, Catalog CL-8000-Continental Pump Co., c. 1981.

*Primary Examiner*—John J. Vrablik

*Attorney, Agent, or Firm*—Jones, Tullar & Cooper

[57] ABSTRACT

A progressive cavity pump of the type having a stator member and a rotor member disposed within a cavity in the stator member and being rotated while being permitted to orbit about a central axis of the stator in operation, one of the members being formed of resilient material and the other of rigid material. The rotor is of helical formation having a constant circular transverse cross-section and defining a single-start thread of a preselected pitch and direction, and the cavity of the stator is in the form of a two start thread of the same direction as the rotor and twice the pitch, the cavity in transverse cross-section has an outline defined by a pair of spaced semi-circular concave ends and a pair of sides joining the semi-circular ends. The semi-circular ends have a diameter slightly less than the diameter of the cross-section of the rotor for establishing an interference fit between the rigid and resilient members. The pair of sides have an inward curvature so that the distance between the pair of sides is slightly less than the diameter of the circular ends whereby sealing areas of increased interference are provided between the members. Unlike known progressive cavity pumps, a high pressure output is possible without making the pump inefficient or of a prohibitive length.

9 Claims, 4 Drawing Sheets

PROGRESSIVE CAVITY PUMP

This application is a continuation of application Ser. No. 638,828, filed Aug. 8, 1984, abandoned.

BACKGROUND OF THE INVENTION

1. Field of the Invention

This invention relates to a progressive cavity pump, commonly known as a Moineau type pump.

2. Description of the Prior Art

Progressive cavity pumps azre used in numerous applications because of various characteristics pecular to this type of pump. This type of pump is capable of operating under adverse conditions, for example, where the liquid being pumped contains abrasive particles such as sand. The pump can be made of a very small diameter so that it can be used in spaces, such as a small borehole, where other pumps could not be used. Known designs of progressive cavity pumps are of a high speed and low pressure design.

In stituations where higher than usual output pressures are required, there has been a tendency to increase the interference between the rotor member and stator member. Only a small increase in pressure can be achieved by increasing the interference between the resilient and rigid members, before the loss in efficiency due to frictional resistance becomes too great. Moreover, too great of an interference may require a starting torque which is larger than can be supplied with an electric motor of an acceptable size.

In drill stem testing, it is common practice to isolate a section of a borehole by locating a pair of spaced packers in the annular space around the stem and injecting drilling mud at a high pressure into the packers so as to expand them and thereby seal off the volume between the packers. Although a pump of the progressive cavity type is ideally suited for use within a borehole because of its shape and ability to pump a drilling mud, pressures of 1500 to 2500 p.s.i. are required. With certain designs of the progressive cavity type pump, it is known that the output pressure can be increased by increasing the length of the pump. However, to increase the pressure to the range indicated above, it has been calculated that for a pump having about a 3" diameter, the length would have to be increased to about 16'. It is questionable that a rotor of this length could be satisfactorily driven, and moreover, a pump of this length would not be practical in the above-described drill stem testing application.

BRIEF SUMMARY OF THE INVENTION

It is an object of the present invention to provide a progressive cavity pump capable of producing an output of a higher pressure than known pumps of this same type without resorting to a significantly increased length.

According to the present invention there is provided a pump having a stator member and a rotor member disposed within the stator member and wherein one of the members is formed of resilient material and the other of a rigid material. The rotor is of helical formation having a constant circular cross-section defining a single-start thread of a preselected direction and pitch. The stator member has an internal cavity in the form of a two-start helical thread of the same direction and twice the pitch length as the rotor member. The cavity in transverse cross-section has an outline defined by a pair of spaced semi-circular concave ends and a pair of sides joining the semi-circular ends, the sides having an inward curvature.

More specifically, the semi-circular ends of the outline of the cavity in the stator member have a diameter slightly less than the diameter of circular shape of the rotor so that there is an interference fit between the resilient and rigid members. Because of the inward curvature of the sides of the outline of the cavity, the distance between the pair of sides is slightly less than the diameter of the semi-circular ends so that there are established areas of increased interference between the rotor and stator members.

BRIEF DESCRIPTION OF THE DRAWINGS

In the accompanying drawings, which illustrate an embodiment of the invention as an example.

DESCRIPTION OF THE PREFERRED EMBODIMENT

Figure 1A:
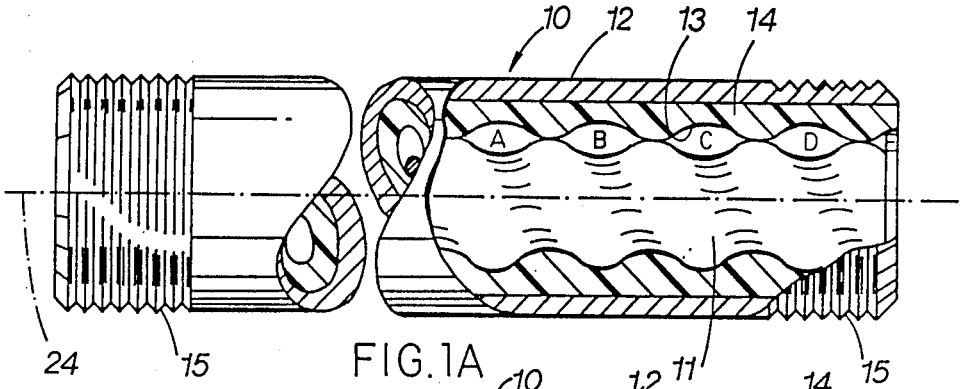
FIG. 1A is a side view of the pump, partially cut away to expose the location of the rotor member within the stator member.
Figure 1B:
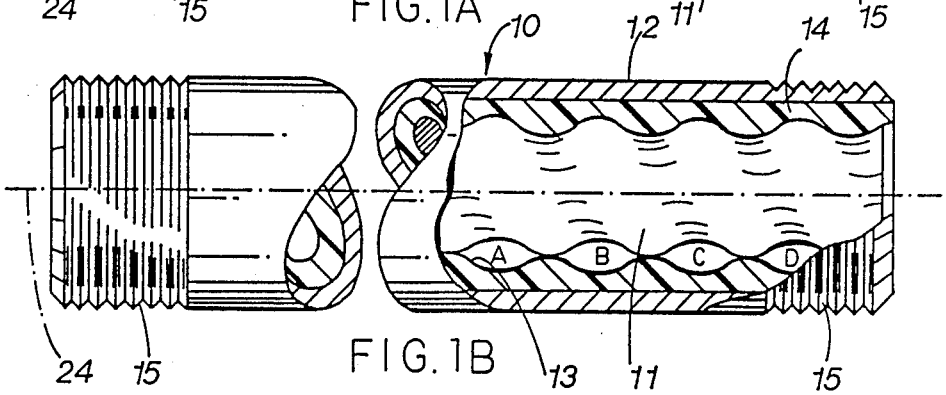
FIG. 1B is a view the same as FIG. 1A, but showing the rotor member rotated through 180°.
Figure 2:
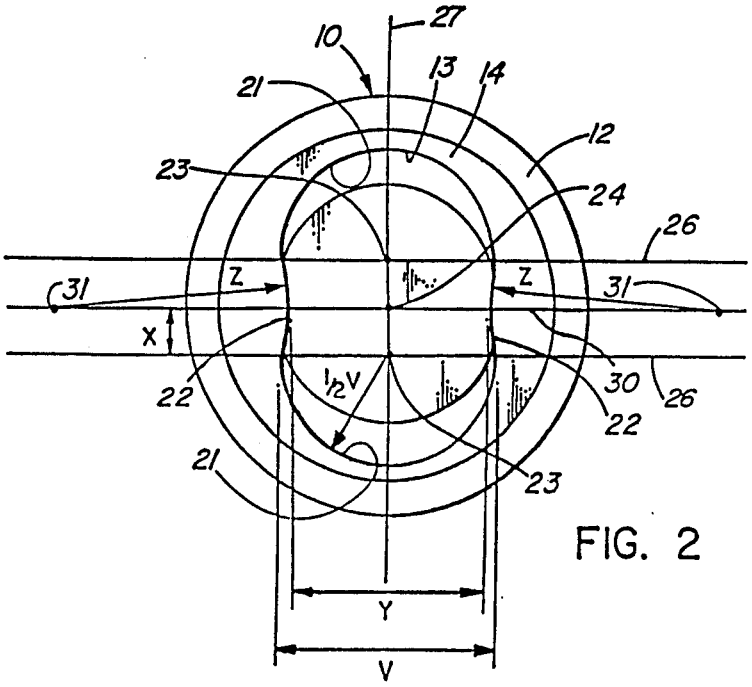
FIG. 2 is an enlarged end view of the stator member.

Referring to FIGS. 1 to 4, the reference numbers 10 and 11 denote the stator member and rotor member, respectively. The stator member 10 is shown as being formed by an external tubular metal member 12 having an internal core 14 of resilient or rubber like material moulded therein to define an elongated cavity 13. The rotor member 11 is formed of metal and is located within the cavity 13. The stator member may be formed of metal with the rotor having at least a resilient outer portion, it being only necesary that with respect to the contacting portions of the two members, one be a rigid member and the other resilient. It is believed, however, that with respect to construction ease and for purposes of exerting a driving force to the rotor, it is most practical to form the rotor of metal and the cavity forming portion of the stator of resilient material.

The tubular metal member 12 may be a steel pipe, externally threaded at either end as indicated at 15,15, and the resilient material, such as elastomer, which may be a urethane, sold under the trade mark "Adiprene", moulded into the pipe. The cavity 13 is formed as the core is moulded into the pipe by utilizing a male mould (not shown) which extends through the pipe when the urethane is poured into the pipe. The male mould is subsequently screwed out of the cavity.

The rotor member may be machined with procedures now well known for turning eccentric configurations. The outer surface of the rotor member is preferably polished and may even be coated with a fraction reducing cover, such as polytetrafluoroethylene sold under the trade mark "Teflon". This is done, of course, to require as little torque as possible to achieve the turning force required to overcome friction between the stator and rotor members, which, as will be described below, are in contact with an interference fit.

Figure 3:
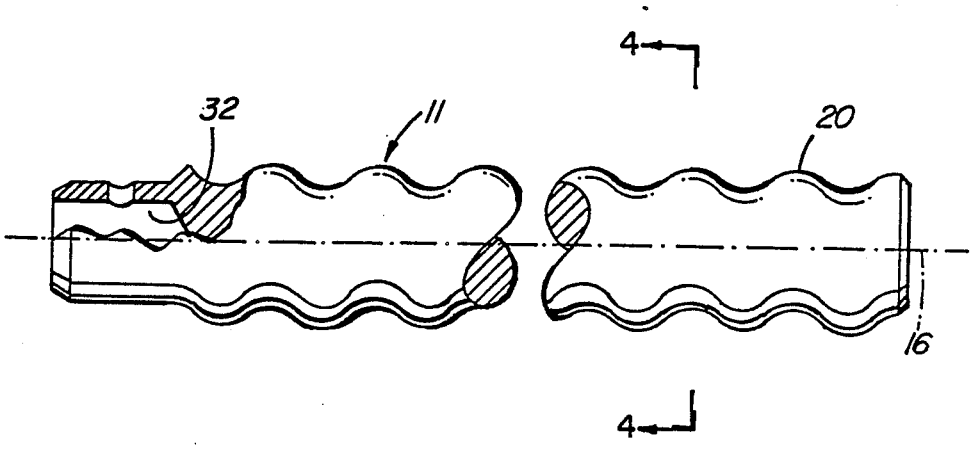
FIG. 3 is a side view of the rotor member partially cut away at one end.
Figure 4:
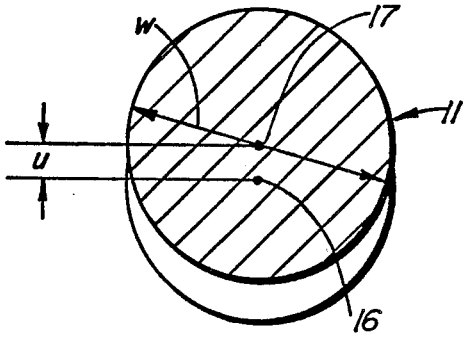
FIG. 4 is an enlarged cross-sectional view of the rotor member taken along the line 4—4 of FIG. 3.

Looking at FIGS. 3 and 4, it can be seen that the rotor member has an elongated helical formation, with a central axis 16. In any cross-section of the rotor member there is a constant shape, namely a circular shape with a centre 17 offset from the central axis 16 by a distance shown as u. The helical formation in effect provides a thread 20 of a preselected direction and pitch length. The helical formation is formed by the circular shape having its centre 17 on a line which spirals about the central axis 16 at the constant eccentric or offset u.

The cavity 13 in the stator member is in the form of a two-start helical thread which extends in the same direction as that of the rotor thread, but each thread of the two-start configuration has a pitch length double that of the rotor. In cross-section the outline of the cavity is defined by a pair of spaced concave semi-circular ends 21,21 with a pair of sides 22,22 joining the semi-circular ends (see FIG. 2). The diameters v of the semi-circular ends are equal to each other and slightly smaller than the diameter w of the circular cross-section shape of the rotor member. Each semi-circle defining the ends of the cavity are struck about a centre 23, the centres 23,23 being disposed on opposite sides of a central axis 24 of the stator member 10. The distance or offset x between each centre 23 and the central axis 24 is substantially equal to the offset u of the rotor member. The sides 22,22 extend between a pair of parallel straight lines 26,26 drawn through the centres 23,23 and perpendicular to a centre straight line 27 drawn through both of the centres 23,23, the distance between the lines 26,26 being equal, of course, to twice the offset of each centre 23, i.e. 2x. Each side has an inward curvature so that the distance y between sides 22,22 is somewhat less than the diameter v of the semi-circular end. The curvature of each side 22 may be the arc of a circle having a radius z, the centre 31 of which is located on a straight line 30 which is midway between lines 26,26 and is parallel to lines 26, 26. The centres 31,31 are located on opposite sides of the cavity outline.

As the rotor member 11 is rotated relative to the stator member 10 within the cavity 13 of the stator member, the single start threads of the rotor interact with the two-start threads of the cavity to form a series of pockets which progress from one end of the stator member to the other. While rotating, the central axis 16 of the rotor member also orbits about the central axis 24 of the stator member. As shown in FIG. 3, one end of the rotor member is provided with a central bore 32 for receiving the end of a drive shaft (not shown) which is affixed thereto. The drive shaft, which includes universal joints, is connected at its other end to the output shaft of a motor which is preferably coaxially aligned with the stator member. The drive shaft rotates the rotor member and permits the above-described orbital movement.

Conduits (not shown) may be threaded onto opposite ends of the stator member, which conduits provide inlet and outlet ports for the fluid being pumped.

Figure 5A:
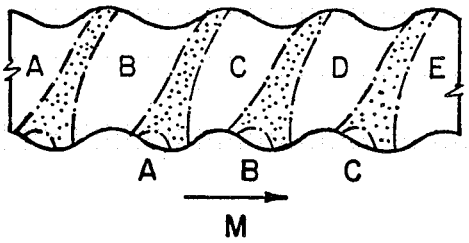
FIGS. 5A to 5D are views of a portion of rotor illustrating in chain-dotted lines the areas of contact between the rotor and stator members, the rotor member of each consecutive view being rotated through an additional 90°.
Figure 5B:
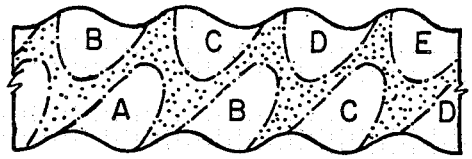
Figure 5C:
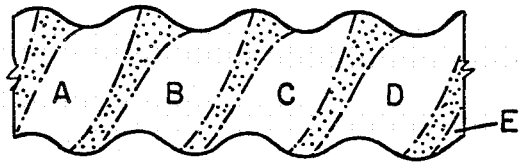
Figure 5D:
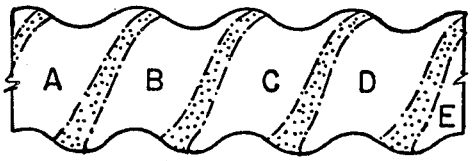

As indicated above, the diameter of the semicircular ends 21,21 of the cross-section cavity configuration is less than the diameter of the circular shape of the rotor member which provides an interference fit between the two members. Thus, in the areas of contact between the two members there is some flattening of the resilient material of the stator member in engagement with a rigid rotor. The areas of engagement which are shown as stippled in FIGS. 5A to 5D trace along the rotor member and progress towards one end of the pump on rotation of the rotor member relative to the stator member, thus in effect pushing the pockets A, B, C, D, E etc. towards an outlet end of the pump. The stippled areas provide the seal between the pockets, the more effective the seal in the stippled areas, the more capable the pump is of producing a higher output pressure. If the rotor is being rotated to cause the pockets to progress in the direction indicated at M in FIG. 5A, the more effective the seal areas, the more resistance there is for the fluid of the flow back towards the inlet. Looking at FIG. 6, the space between lines O-P represents 360° of the surface of the rotor. If the outlet end of the pump is at high pressure then there would be a tendency for the fluid in pocket E to flow back to D and even C, the fluid from pocket D to flow back to pockets C and B etc. The resistance to the flow across the seal area from a pocket closer to the output end to a pocket closer to the input end establishes a pressure differential capability between each consecutive pocket. These pressure differentials are substantially additive along the length of the pump to establish the total head capability of the pump. This explains, of course, the previously known approach of increasing the length of the pump to achieve a higher output pressure in known pumps where only a small differential between consecutive pockets has been possible, the problem was approached by increasing the number of pockets in progress. The numerous arrows shown in FIG. 6 illustrate, as an example, areas of the seal across which there would be tendency of flow from pocket C to pocket B and even to pocket A when an attempt is made to pump the fluid to a high output pressure.

Figure 6:
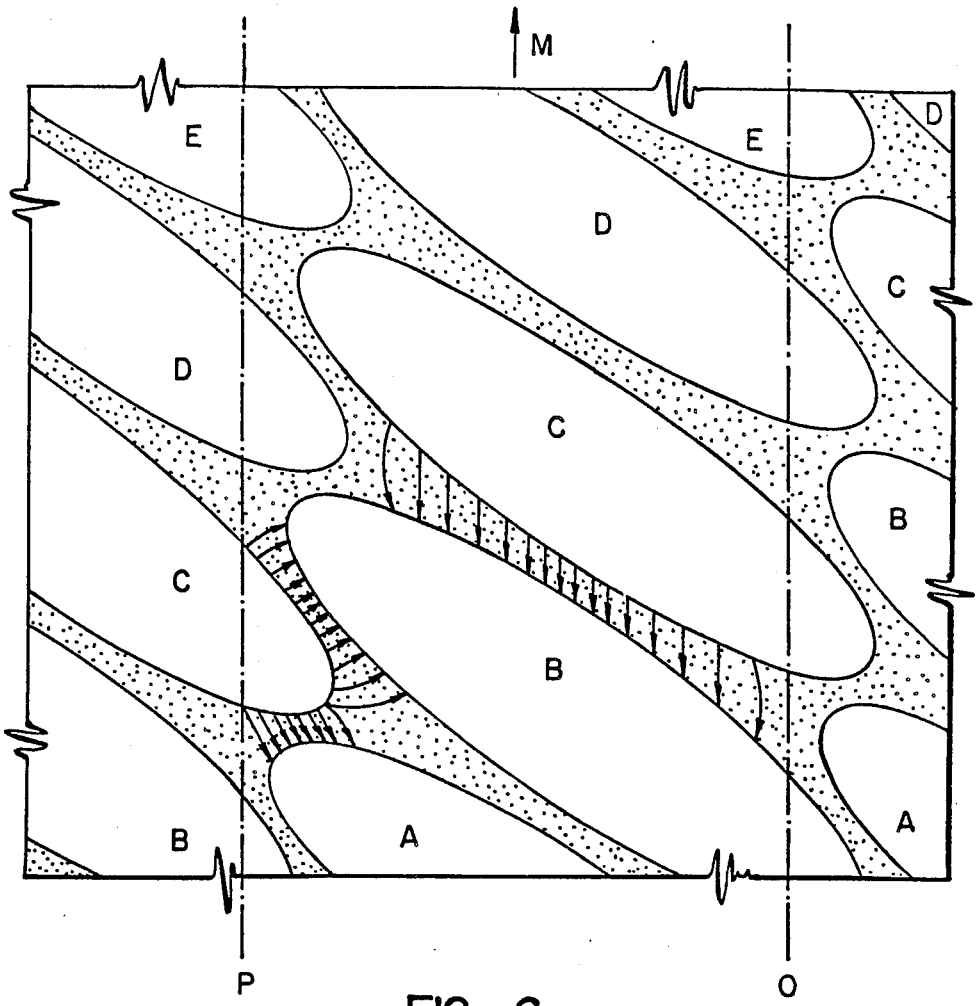
FIG. 6 is a developed view of a section of a rotor member and depicting the areas occupied by the pockets of fluid being pumped and the areas of contact between the rotor and stator members.

The particular configuration of the outline of the cavity in the pump of the present invention, and more particularly the inwardly curved sides 22,22 is believed to result in an area of more concentrated pressure between the stator and rotor members within the stippled areas shown in FIGS. 5 and 6, and thus provide a possible output pressure many times that which has been previously available with the Moineau pump. As indicated above, design calculations for known progressive cavity pumps indicate pressures in excess of 2000 p.s.i. would require a length of 16 feet, whereas pumps built in accordance with the present invention and having a length of only 1 foot have produced output pressures well in excess of 2500 p.s.i. According to one design of the pump of the present invention, the total length of the stator member shown in FIGS. 1A and 1B was 12", the pitch length of the rotor was 1.500", and the diameter of the circular shape of the rotor 'w' was 1.55 having an offset 'u' of 0.300". In the cavity outline, the diameter of the semi-circular ends 'v' was 1.480" with an offset 'x' of 0.310", the radius of the arcs of the sides 'z' was about 1.375". With the above dimensions, a hardness of Shore 55D for the resilient core of the stator member core was found to produce good results, but a hardness of Shore 65D produced better results. Tests using a rotor and stator members with the same dimensions identified above but wherein rotor members having diameters 'w' equal to 1.542", 1.538" and 1.532" were also conducted and provided excellent results with respect to output pressures but falling off somewhat from that achieved with a diameter of 'w' equal to 1.55.

As is indicated in the above example, the pitch length of the rotor is 1.500" as compared to 1.55" for the diameter of the circular cross-section of the rotor. This pitch to rotor diameter ratio of approximately 1:1 is lower than that normally used in commercially available units. However, because the total capable head of the pump is the addition of the pressure differentials which can be established between consecutive pockets, the lower pitch to rotor diameter ratio results in a greater number of pockets per unit length of the pump, and thus, a capability of producing a higher head for a pump of a given length.

It is apparent that various modifications may be made to the single embodiment of the inventions, which is decribed above as an example, without departing from the spirit of the invention as defined in the appending claims.

I claim:

1. A progressive cavity pump comprising a stator member and a rotor member disposed within the stator member, one of said members being formed of resilient, rubber-like material and the other of a rigid, metal material, said rotor member being of helical formation having a circular shape constant in diameter at any transverse cross-section, and thereby providing a single-start thread of preselected direction and length, the ratio of the pitch of the rotor to the diameter of the circular shape of the rotor being no greater than approximately 1:1, said stator member having an internal cavity in the form of a two-start helical thread of the same direction and twice the pitch length of the rotor member, said cavity in transverse cross section having an oblong outline defined by a pair of spaced concave semi-circular ends and sides joining the semi-circular ends, the semi-circular ends having a diameter slightly less than the diameter of the circular shape of the cross section of the rotor for establishing an interference fit between said resilient and rigid members and thereby providing areas of substantially constant contact pressure between the rotor and semi-circular ends of the cavity in the stator, said pair of sides having an inward curvature whereby the distance between said pair of sides is sufficiently less than the diameter of said semi-circular ends to establish an increased interference and thereby provide an increased area of contact between the rotor and the inward curved sides of the cavity of the stator and wherein said contact area has pressure contact greater in magnitude than said contact pressure between the rotor and the semi-circular ends, the inward curvatures of the sides being arcs of circles having centers outside of the cavity on opposite sides thereof, the radii of the arcs forming the inward curvatures being slightly less in length than the diameter of the semi-circular ends.

2. A pump as defined in claim 1, wherein said helical formation of said rotor is provided by said circular shape having the center thereof on a line spiralling about a central axis of the rotor at a constant offset to said central axis, and wherein the semi-circular ends of the cross-sectional shape of said cavity are struck about centers on opposite sides of a central axis of said stator, said centers of said semi-circular ends each being offset from said central axis of said stator a distance substantially equal to said offset of the center of the circular shape of said rotor.

3. A pump as defined in claim 1, wherein sides of the cross-sectional shape of said cavity extend between a pair of parallel straight lines each extending through one of the centers of said semi-circular ends, said pair of parallel lines being at right angles to a straight center line of said cavity passing through both of the centers of said semi-circular ends.

4. A pump as defined in claim 3, wherein the centers of the arcs of circles are on a common straight line parallel to and midway between said pair of parallel lines.

5. A pump as defined in claim 3, wherein the ratio of diameter of the semi-circular ends to the diameter of the circular shape of the rotor is approximately 1.48:1.55.

6. A pump as defined in claim 1, wherein the ratio of the radius of each arc to the diameter of the circular shape of the rotor is approximately 1.37:1.55.

7. A pump as defined in claim 1, wherein the ratio of the constant offset of the center of the circular shape of the rotor to the diameter of the circular shape of the rotor is approximately 0.30:1.55.

8. A pump as defined in claim 1, the ratio of the offset of center of each semi-circular end of the cavity from the central axis of the stator member to the diameter of the circular shape of the rotor is approximately 0.31:1.55.

9. A pump as defined in claim 1, wherein said stator member has a hardness of approximately Shore 65D.

* * * * *